US006530305B1

(12) United States Patent
MacLeod et al.

(10) Patent No.: US 6,530,305 B1
(45) Date of Patent: Mar. 11, 2003

(54) TELESCOPING PRESSURE-BALANCED GAS GENERATOR LAUNCHERS FOR UNDERWATER USE

(75) Inventors: Brenda Brennan MacLeod, Nashua, NH (US); Jeffrey L. Cipolla, Newport, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/932,725

(22) Filed: Aug. 20, 2001

(51) Int. Cl.[7] ..... F41F 3/00; F41F 3/07; F41F 3/08

(52) U.S. Cl. ..... 89/1.81; 89/1.809; 114/318; 114/319; 114/238

(58) Field of Search ..... 89/1.81, 1.809; 114/238, 318, 319

(56) References Cited

U.S. PATENT DOCUMENTS 4,037,821 A * 7/1977 Greene ..... 254/93 R
4,531,445 A * 7/1985 Nee ..... 89/1.813
4,616,554 A * 10/1986 Spink et al. ..... 89/1.806
5,363,791 A * 11/1994 Stallard, III ..... 114/318
5,398,588 A * 3/1995 Peck ..... 89/1.806
5,918,307 A * 6/1999 Cipolla ..... 89/1.81

FOREIGN PATENT DOCUMENTS

GB 2078912 * 1/1982

* cited by examiner

*Primary Examiner*—Charles T. Jordan
*Assistant Examiner*—John W. Zerr
(74) *Attorney, Agent, or Firm*—James M. Kasischke; Michael F. Oglo; Jean-Paul Nasser

(57) ABSTRACT

A launching apparatus including a launch tube having fore and aft ends, each end having an opening formed therein. A muzzle cap is fitted to the fore end and a breech mounting is formed at the aft end. A primary housing is seated in the aft end, the primary housing having fore and aft ends. A first telescoping cylinder containing a first telescoping piston is positioned within the fore end of the housing and a second telescoping cylinder containing a second telescoping piston is positioned within the aft end of the housing. A ram plate and a breech mounting are connected to the first and second pistons respectively. A gas generator is provided within the housing and a projectile is seated between the ram plate and muzzle cap. The first and second cylinders and the first and second pistons expand from the housing and propel the projectile.

6 Claims, 4 Drawing Sheets

TELESCOPING PRESSURE-BALANCED GAS GENERATOR LAUNCHERS FOR UNDERWATER USE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to a pressure balanced gas generator launcher.

More particularly, the invention relates to a pressure balanced gas generator launcher having telescoping elements capable of extending the provision of launch forces.

(2) Description of the Prior Art

Currently, pressure balanced gas generator launchers are under development. Ramming length limitations require that the gas generator accelerate the projectile very rapidly in order to provide the required launch speed. These relatively high accelerations require that the projectile be designed to very high shock standards. Thus, a problem exists in the art whereby it is necessary to develop launchers providing high accelerations in order to accommodate those projectiles requiring a high launch speed.

The following patents, for example, disclose various types of launchers, but do not disclose a gas generator launcher as does the present invention which utilizes extended expansion from a single primary cylinder housing.

U.S. Pat. No. 3,256,777 to Choate et al.;

U.S. Pat. No. 3,371,578 to Choate et al.;

U.S. Pat. No. 3,745,876 to Rocha;

U.S. Pat. No. 3,859,890 to Guthrie;

U.S. Pat. No. 4,037,821 to Greene;

U.S. Pat. No. 4,531,445 to Nee;

U.S. Pat. No. 4,616,554 to Spink et al.; and

U.S. Pat. No. 5,398,588 to Peck.

Specifically, Choate et al. '777 disclose a rocket launcher having first and second tubular sections that are telescopingly connected to enable the launcher to be extended into an elongated position of use from a shortened, inoperative position with the first section being the breech end and fitting within the second section. During movement of the launcher sections from a predetermined partly extended position into a fully extended position, the firing member is moved into its cocked position, the firing spring becomes operatively tensioned, and the launcher sections become locked together.

The patent to Choate et al. '578 discloses a rocket launcher of the type having first and second tubular sections telescopingly connected to enable them to be extended from a shortened inoperative position into an elongated operative position.

The general objective of Choate et al. '578 is to provide that type of launcher with improved safety features and to provide basic constructions for those in production of launchers whether the rockets to be launched therefrom are to be ignited by percussion or electrically and also in the production of launchers for use in firing sub-caliber practice rounds.

Rocha discloses a telescopic firearm including a firing tube for the discharge of a projectile, a blast deflector, a flash deflector for receiving said firing tube and blast deflector when telescoped thereinto, covers mounted by hinges on said flash deflector for closing the ends thereof, and a sight system incorporated in said covers.

Guthrie discloses a projectile launching device in which a projectile or warhead is mounted in an ejection tube in the form of a piston and the ejection tube is mounted in a launching tube. A propellant charge in the ejection tube supplies gas pressure to the projectile to force the projectile out the ejection tube, and a rocket nozzle located to the rear of the propellant charge receives gases from a combustion of propellant charge to eject the ejection tube from the launching tube.

The patent to Greene discloses a telescoping retractor comprised of a two stage cylinder assembly actuated by an electroexplosive power cartridge. A pair of cylinders are mounted in concentric relation. A piston rod is carried in the inner cylinder. The power cartridge produces the gas which sequentially retracts the outer cylinder, the inner cylinder and then the piston which is secured to the structure to be retracted.

Nee discloses a projectile launcher having first and second telescopingly connected sections enabling it to be extended into an operative state when it is to be discharged. The firing mechanism has a firing member carried by the first section which extends into a housing on the second section. The rear of the housing is a chamber for a pivoted trigger having a forward portion of greater length than its rearward portion and underlying a boot covered part. A rotary sear in the chamber has first and second arcuately spaced shoulders the second of which is engaged and held by the rearward trigger portion under the influence of a spring. When but a short further relative movement between the sections is required to fully extend the launcher, the first sear shoulder engages and pulls forward the firing member thus to cock the firing mechanism when the launcher is fully extended, the firing spring then exerting a substantial force against the first shoulder. While the difference in lengths of the trigger portion offers the user a theoretical mechanical advantage, the place where the effective pressure of the fingers applied thereagainst through the boot is an uncertain and variable factor causing inaccuracy in use due to the resulting variations in the force required to pull the trigger. The radial distances of the sear shoulders are such that the force exerted by the second sear shoulder is so reduced that said factor is minimized to an extent enabling the use of such launchers to be attended with increased accuracy.

The patent to Spink et al. discloses an extendable rocket launcher tube for a rocket wherein releasable telescoped concentric inner and outer tubes house the rocket. Upon ignition, the rocket releases the inner tube from the outer tube and carries it forward imparting momentum thereto. The rocket is released from the inner tube at a selected axial extension of the inner tube. The components move at relative speeds such that acceleration of the rocket is complete when the launcher tube is fully extended.

Peck discloses a missile launching system for launching a missile including an automatically telescoping launch tube and a restraining system. The telescoping launch tube lengthens the period of guided travel of the missile during launch, to improve its accuracy. The launch tube system has an outer case and an inner launch tube internally dimensioned to receive the missile therein and externally dimensioned to slide within the outer case from a rearward position to a forward position. The restraining system holds the missile and inner launch tube at the proper locations before and during firing, and includes a releasable holdback for the inner launch tube at the rearward position and a releasable holdback for the missile at a preselected position within the inner launch tube. The inner launch tube is restrained so that it may not slide past the forward position relative to the outer case at the end of its travel during the launching sequence.

It should be understood that the present invention would in fact enhance the functionality of the above patents by providing substantial additional extension from a single primary cylinder housing by permitting staged and advancing telescoping functions from both ends of the primary cylinder housing. The primary housing holds plural internal cylinders which selectively expand in reaction to a gas generator.

SUMMARY OF THE INVENTION

Therefore it is an object of this invention to provide a gas generator launching apparatus.

Another object of this invention is to provide a gas generator launching apparatus having reduced launch acceleration.

Still another object of this invention is to provide a gas generator launching apparatus capable of providing the necessary launch velocity from a compact space.

A still further object of the invention is to provide a gas generator launching apparatus in which internal and external pressures are balanced for functioning in pressurized environments.

Yet another object of this invention is to provide a gas generator launching apparatus having an extended ramming length for use in an underwater environment.

In accordance with one aspect of this invention, there is provided a launching apparatus including a launch tube having a fore end and an aft end, each end having an opening formed therein. A muzzle cap is fit to the fore end of the launch tube and a breech mounting is formed at the aft end of the launch tube. A primary plenum housing is seated in the aft end of the launch tube, the primary housing having a fore end and an aft end. A first telescoping cylinder is initially positioned within the fore end of the primary housing and a second telescoping cylinder is initially positioned within the aft end of the primary housing. A first telescoping piston is positioned in the first telescoping cylinder, and a second telescoping piston is positioned in the second telescoping cylinder. A ram plate is connected to the first telescoping piston, and the second telescoping piston is connected to the breech mounting. A gas generator is provided in connection with said primary housing. A projectile is seated between the ram plate and the muzzle cap. The first and second telescoping cylinders and the first and second telescoping pistons expand in multiple stages of extension from the main housing and propel the projectile.

BRIEF DESCRIPTION OF THE DRAWINGS

The various objects, advantages and novel features of this invention will be more fully apparent from a reading of the following detailed description in conjunction with the accompanying drawings in which like reference numerals refer to like parts, and in which.

DESCRIPTION OF THE PREFERRED EMBODIMENT

In general, the present invention is directed to a telescoping pressure-balanced gas generator launcher. The primary purpose of a pressure-balanced gas generator launcher is to increase the ramming length over that of the non-telescoping pressure-balanced gas generator. By increasing the ramming length, the necessary acceleration is reduced for projectiles requiring high exit velocities.

Figure 1:
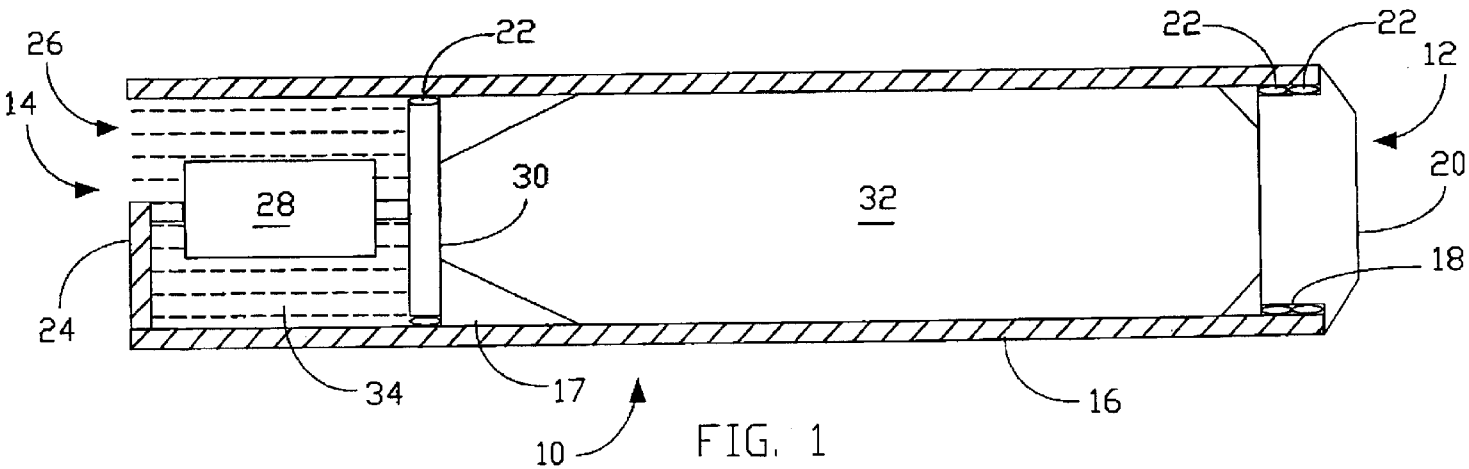
FIG. 1 is a side sectional view of a launcher configuration according to the present invention.

Referring first to FIG. 1 of the present invention, the telescoping pressure-balanced gas generator launcher is generally illustrated at 10. The launcher 10 includes a fore end 12, an aft/breech end 14, and an elongate housing portion 16. The fore end 12 of the launcher 10 has an opening 18 formed therein. Before launch, the opening 18 is blocked by a removable muzzle cap 20. The muzzle cap 20 is surrounded by sealing members 22 thereby providing a water tight seal for an interior of the elongate housing 16 of the launcher 10. The aft end 14 of the housing 16 includes a partial end wall or strut, also referred to as a breech mounting 24. An opening 26 allows communication of environmental fluid such as seawater 34 into the aft end 14 of housing 16.

A telescoping plenum assembly 28 is located adjacent the aft end 14 of the housing 16 and is connected at one end to the breech mounting 24 and at its opposite end to a ram plate 30. Prior to use, the telescoping plenum assembly 28 is surrounded by seawater 34. A launch projectile 32 is seated within the housing 16 between the ram plate 30 and the muzzle cap 20. The ram plate 30 is sealed against an inner surface 17 of the housing 16 with sealing member 22 which prevent seawater 34 from contacting the launch projectile 32.

Figure 2:
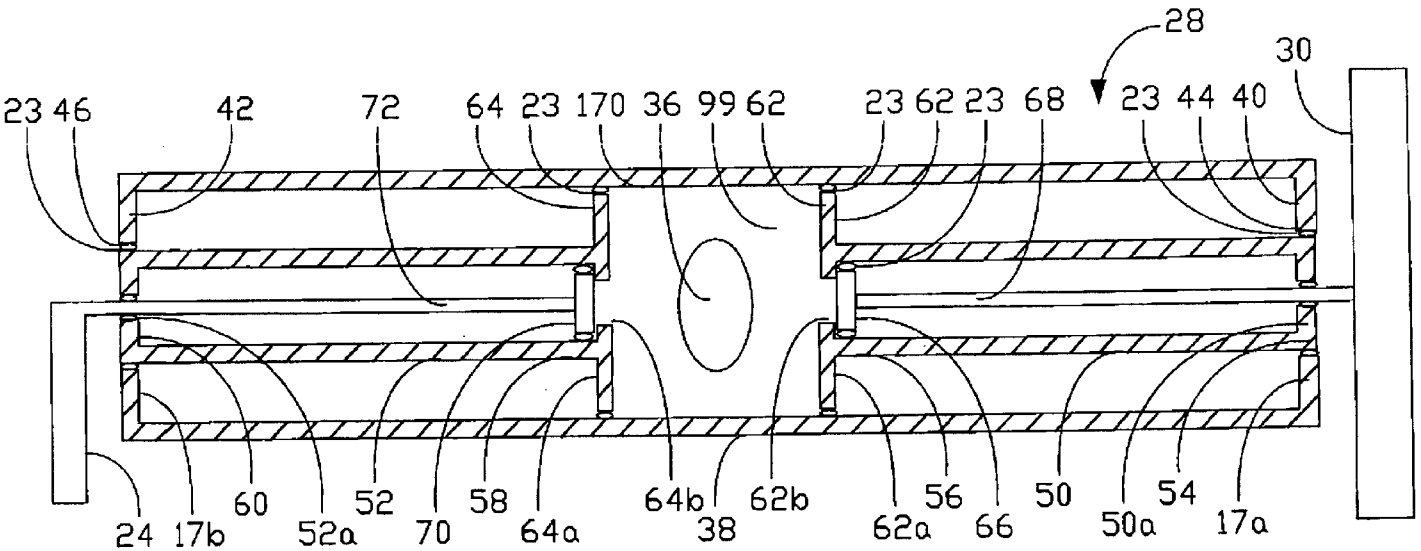
FIG. 2 is a side sectional view of a telescoping plenum assembly schematic in pre-launch according to a preferred embodiment of the present invention.

Referring now to FIG. 2, the telescoping plenum assembly 28 includes key components of the launcher configuration by incorporating staged and multiple expansions of elements therein. Specifically, the telescoping plenum assembly 28 is formed as a single main cylinder 38 having a first end 40 and a second end 42. An opening 44 is formed in the first end 40 and an opening 46 is formed in the second end 42 of the plenum assembly 28.

At least two telescoping cylinders are housed within the plenum assembly 28. One of the telescoping cylinders is a first inner cylinder 50 and another of the telescoping cylinders is a second inner cylinder 52. The first inner cylinder 50 includes a distal end 54 and a proximate end 56, such that the distal end 54 terminates in the opening 44 of the main cylinder 38. The second inner cylinder 52 also includes a proximate end 58 and a distal end 60, such that the distal end 60 terminates in the opening 46 of the main cylinder 38. Sealing rings 23 or similar appropriate devices are provided at the distal end 54 of the first inner cylinder 50 and at the distal end 60 of the second inner cylinder 52 to seal out the external environment of, for example, seawater 34.

The proximate end 56 of the first inner cylinder 50 and the proximate end 58 of the second inner cylinder 52 terminate in a flange 62, 64, respectively. Flange 62 includes an outward radial portion 62*a* and an inner rib 62*b*. The outward radial portion 62*a* is in surface contact with the inner surface 170 of the housing 38 and the inner rib 62*b* is smaller in diameter than an inner diameter of the first inner cylinder 50. A first piston member having a piston head 66 and a piston shaft 68 is slidably positioned within the first inner cylinder 50 such that in a retracted position the piston head 66 abuts the inner rib 62*b* of the flange 62. A distal end of the first piston shaft 68 is connected to the ram plate 30.

Flange 64 includes an outward radial portion 64*a* and an inner rib 64*b*. The outward radial portion 64*a* is in surface contact with the inner surface 170 of the housing 38 and the inner radial portion 64*b* is smaller in diameter than an inner diameter of the second inner cylinder 52. A second piston member having a piston head 70 and a piston shaft 72 is formed within the second inner cylinder 52 such that the piston head 70 abuts the inner rib 64*b* of the flange 64. A distal end of the second piston shaft 72 is connected to the breech mounting 24. Each piston head 66, 70 is slidably sealed by seal 23 within its respective inner cylinder 50, 52. A gas generator 36 is positioned in a plenum 99 within housing 38 between the first inner cylinder 50 and the second inner cylinder 52. Gas generator 36 can be activated by any control apparatus well known in the art.

With the arrangement of elements as described, it will be understood that the first inner cylinder 50 is telescopingly slidable through the opening 44 of the main cylinder 38, and the shaft 68 of the first piston is telescopingly slidable through the outer opening 50*a* of the first inner cylinder. Likewise, the second inner cylinder 52 is telescopingly slidable through the opening 46 of the main cylinder 38, and the shaft 72 of the second piston is telescopingly slidable through the outer opening 52*a* of the second inner cylinder 52.

Upon complete expansion of the plenum assembly 28, the outer flanged portion 62*a* of the first inner cylinder 50 is in contact with an inner end surface 17*a* of the main cylinder 38, the piston head 66 of the first piston is in surface contact with the outer opening 50*a* of the first inner cylinder 50, the flanged portion 64*a* of the second inner cylinder 52 is in surface contact with the inner breech end 17*b* of the main cylinder 38, and the piston head 70 of the second piston member is in surface contact with the outer opening 52*a* of the second inner cylinder 52.

FIGS. 3A, 3B, 3C, and 3D illustrate the operation of the launcher device 10. It should be noted that the expansion of the plenum/piston stages does not necessarily occur in the order of these FIGS., and may in fact occur simultaneously.

Figure 3A:
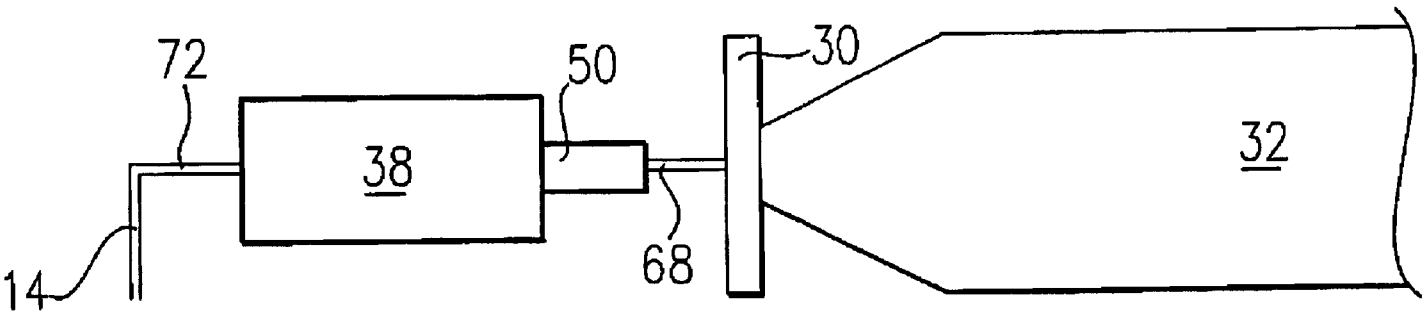
FIG. 3A is a schematic diagram showing a first stage of launch.
Figure 3B:
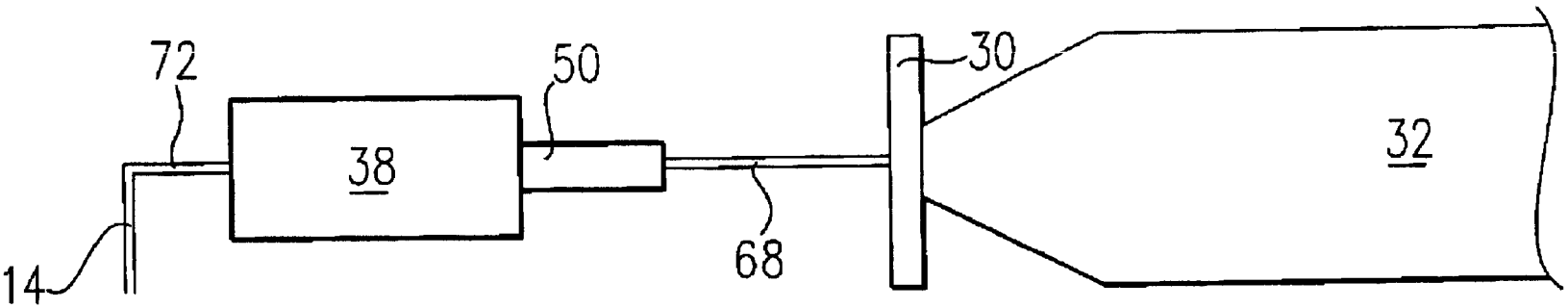
FIG. 3B is a schematic diagram showing a second stage of launch.
Figure 3C:
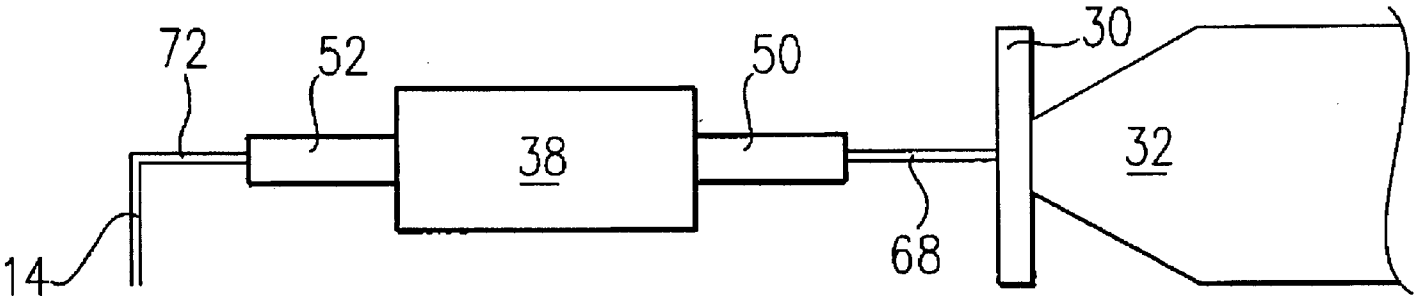
FIG. 3C is a schematic diagram showing a third stage of launch.
Figure 3D:
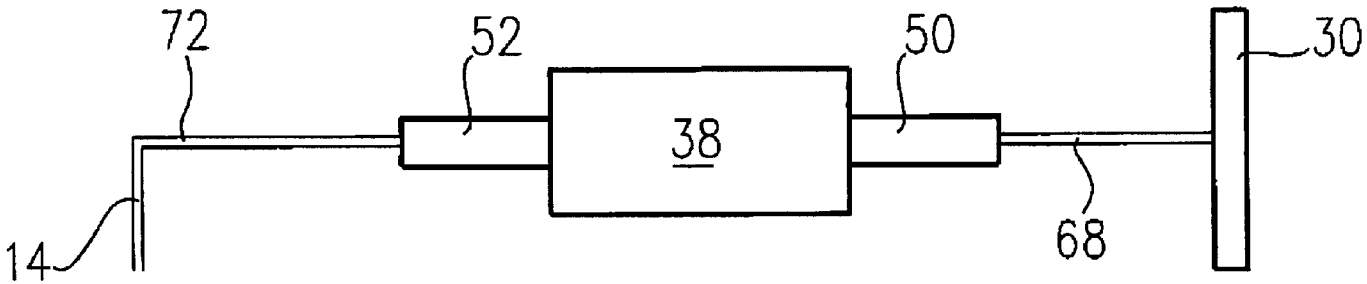
FIG. 3D is a schematic diagram showing end of launch.

In FIG. 3A, when the gas generator 36 pressurizes the plenum 99, the first inner cylinder 50 and corresponding piston slide forward inside the main cylinder 38, pushing the ram-plate 30, projectile 32, and muzzle cap 20 out of the launch tube 10. In FIG. 3B, the first inner cylinder 50 catches once the flange 62 reaches the first end 40 of the main cylinder 38, but the first piston continues to slide forward until the head 56 reaches the outer end 54 of the first inner cylinder 50. In FIG. 3C, the main cylinder 38 begins to move forward dragged by the flange 62 of the first inner cylinder 50. When the aft end 42 of the main cylinder 38 catches on the flange 64 of the second inner cylinder 52, the second inner cylinder 52 begins sliding forward. In FIG. 3D, the plenum 99 continues to expand (and push out the projectile 32) until the outer end 60 of the second inner cylinder 52 catches on the second piston head 70. Pistons and cylinders are sealed against each other as shown with sealing members 22, 23.

Since ocean pressure acts on both ends of the projectile 32 (through the muzzle cap 20 and the ram plate 30), the gas generator 36 need only supply enough energy to overcome losses, expand the volume of the plenum assembly 28, and accelerate the stages of the telescoping plenum assembly 28, the ram plate 30, the projectile 32, and the muzzle cap 20. The key to keeping this launcher truly pressure-balanced is minimizing the volume of the telescoping cylinders 50, 52. Otherwise, the gas generator 36 must do more work against ocean pressure in order to expand the plenum assembly 28.

The launch tube 10 and breech mounting 14 are reusable since they don't come in contact with the combustion products of the gas generator 36. Depending on the nature of the combustion products, the telescoping plenum 28 may also be reusable during a limited lifetime.

Figure 4:
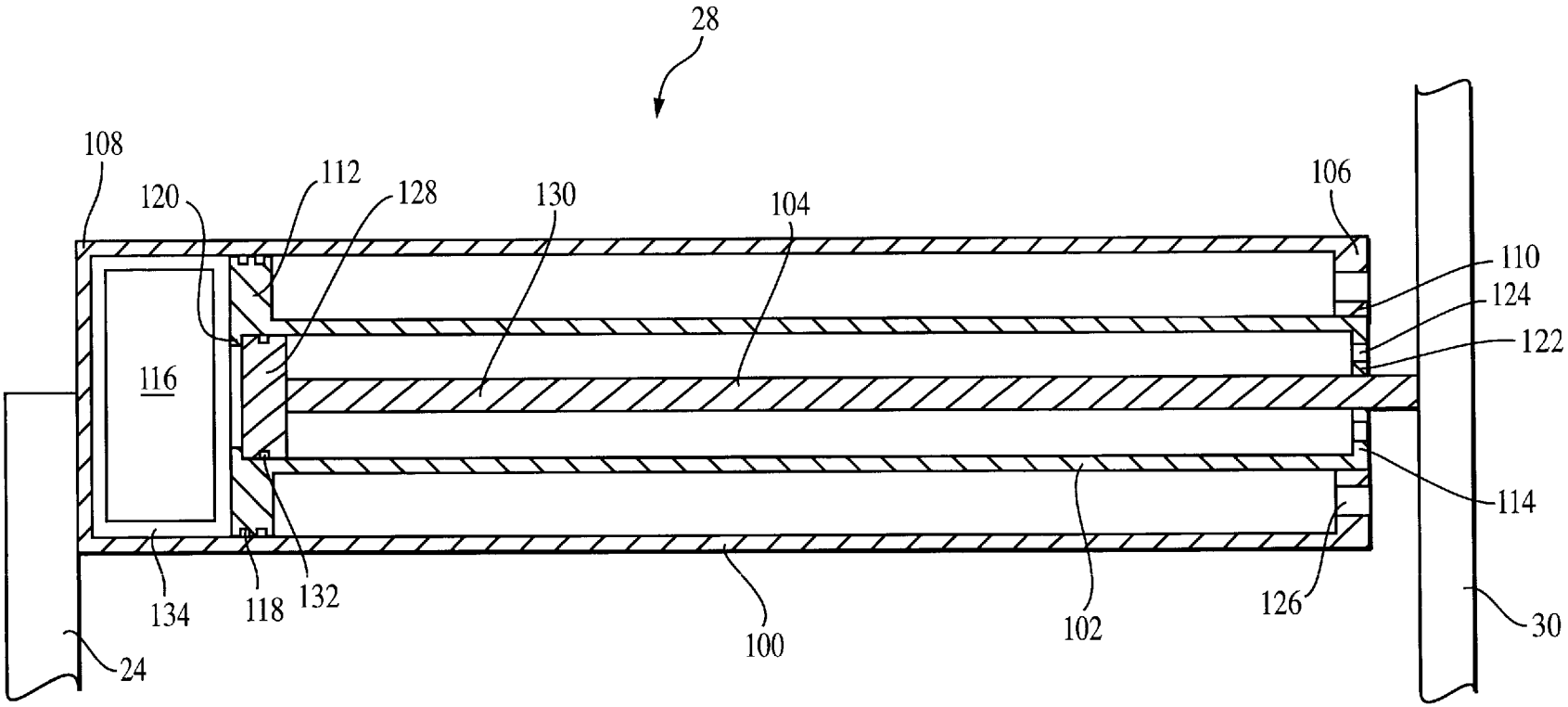
FIG. 4 is a schematic diagram showing an alternative embodiment of a launcher configuration according to the present invention.

FIG. 4 shows an alternate embodiment of the plenum assembly 28 of the current invention. This embodiment provides a main cylinder 100 having a single inner cylinder 102 and piston assembly 104. The main cylinder 100 is hollow and has a forward end 106 and an aft end 108 with the aft end 108 being sealed and joined directly to the breech mounting 24. The forward end 106 includes a stop ring 110 positioned thereon such that the stop ring 110 has a radius reduced from that of the main cylinder 100.

The inner cylinder 102 is likewise hollow and includes an outwardly flanged aft end 112 and an inner cylinder forward end 114. The inner cylinder 102 is positioned within the main cylinder 100 such that the flanged aft end 112 is oriented toward the main cylinder aft end 108. A gas source 116 is provided inside main cylinder 100 and adjacent the flanged aft end 112 of the inner cylinder 102. The flanged aft end 112 has an increased external radius from the external radius of the inner cylinder 102. A sliding fit exists between the flanged aft end 112 and an inner surface of the main cylinder 100, and an outer periphery of the flanged aft end 112 is sealed against the main cylinder 100 by a plurality of sliding seals 118. The flanged aft end 112 also has a shoulder 120 extending into the hollow portion of the inner cylinder and thereby reducing the inner diameter thereof.

The forward end 114 of the inner cylinder 102 extends through the stop ring 110 at the forward end 106 of the main cylinder 100. The inner surface of the stop ring 110 has a bearing surface therein allowing sliding of the inner cylinder 102 out from the main cylinder 100. The forward end 114 of the inner cylinder 102 has a piston support flange 122 for narrowing the radius of the interior surface of the inner cylinder 102. A plurality of fluid communication ports 124 are provided in the piston support flange 122, thereby allowing communication between the environment and the hollow interior of the inner cylinder 102.

The flanged aft end 112 and stop ring 110 bearing surface prevent canting of the inner cylinder 102 with respect to the main cylinder 100 by supporting the inner cylinder 102. A plurality of fluid communication ports 126 are formed in the stop ring 110 to allow environmental fluid to escape from the hollow portion remaining between the main cylinder 100 and the inner cylinder 102 when the inner cylinder slides with respect to the main cylinder 100. Upon extension of the inner cylinder 102 from the main cylinder 100, the increased radius of the flanged aft end 112 engages with the decreased radius of the stop ring 110, thereby preventing the inner cylinder 102 from leaving the main cylinder 100.

Communication ports such as 124 and 126 are optional because they introduce the risk of corrosion from seawater into the piston assembly 104 and generate viscous drag as environmental fluid is pushed out of the piston assembly 104. The pressure generated by the gas source 116 is more than enough to overcome the back pressure generated by gas trapped in between the cylinders 100 and 102. The back pressure has the benefit of preventing contact between the flange 112 and stop ring 110 at the end of the piston stroke. Check valves could be provided in communication ports 124 and 126 to prevent entry of seawater therethrough.

Piston assembly 104 including a piston 128 and a piston shaft 130 is slidably disposed in the hollow portion of the inner cylinder 102. The piston 128 is sealed against an inner surface of the inner cylinder 102 with a sliding seal 132. The piston shaft 130 is joined to the piston 128 and extends forward through the piston support flange 122. At its extreme forward end, the piston shaft 130 is joined to the ram plate 30. When not extended, the piston 128 is positioned against the shoulder 120 of the flanged aft end 112. The piston support flange 122 engages with the piston 128 and prevents the piston assembly 104 from sliding out of the hollow interior portion of the inner cylinder 102.

Upon activation of the gas source 116, pressure is generated in a plenum 134 defined between the surface created by the inner cylinder flanged aft end 112 and piston 128 and the main cylinder aft end 108. Generated pressure pushes the inner cylinder 102 forward from the main cylinder 100 and the piston assembly 104 forward from the inner cylinder 102. The ram plate 30 is pushed outward by contact with the piston shaft 130. Environmental fluid is expelled from the region between the main cylinder 100 and inner cylinder 102 through fluid communication ports 126. Likewise, fluid is expelled from the region between piston assembly 104 and inner cylinder 102 through fluid communication ports 124.

These telescoping pressure balanced gas generator launcher designs increase the ramming length of the non-telescoping pressure-balanced launcher by a factor of two, which cuts the average acceleration requirement by one-half.

Alternatives to this design of a telescoping pressure-balanced gas generator launcher include variations in the number of telescoping cylinders and in the number of main cylinders attachable to one another so as to multiply the ramming length. Variations in cylinder/piston geometry also may occur (i.e. they need not be truly "cylindrical"). Many different types of gas generators could be used to pressurize the plenum.

In view of the above detailed description, it is anticipated that the invention herein will have far reaching applications other than those of underwater launch systems.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A launching apparatus comprising:

a launch tube having a fore end and an aft end, each end having an opening formed therein;

a muzzle cap fit to the fore end of said launch tube;

a breech mounting formed at the aft end of said launch tube;

a primary housing positioned in the aft end of said launch tube forward of said breech mounting, said primary housing having a fore end and an aft end;

a first telescoping cylinder slidably positioned within the fore end of said primary housing;

a second telescoping cylinder slidably positioned within the aft end of said primary housing;

a first telescoping piston slidably disposed in said first telescoping cylinder;

a second telescoping piston slidably disposed in said second telescoping cylinder and joined to said breech mounting;

a gas generator provided within said primary housing between said first telescoping cylinder and said second telescoping cylinder;

a ram plate positioned in said launch tube and connected to said first telescoping piston; and a projectile seated between said ram plate and said muzzle cap.

2. The apparatus according to claim 1 wherein said muzzle cap and said ram plate form a fluid tight seal against said launch tube preventing entry of environmental elements.

3. The apparatus according to claim 1 wherein:

said first telescoping cylinder includes a first end having an outwardly flanged end wall and a second end opposite the first end; and said primary housing having a fore end stop flange positioned in said primary housing fore end, said first telescoping cylinder outwardly flanged end wall engaging with said fore end stop flange of said primary housing on extension of said first telescoping cylinder.

4. The apparatus according to claim 3 wherein said first telescoping piston includes:

a piston head slidable between the first and second ends of said first telescoping cylinder; and a piston shaft connected at one end to said ram plate and at the other end to said piston head, said piston shaft being slidably supported within the second end of said first telescoping cylinder.

5. The apparatus according to claim 3 wherein:

said second telescoping cylinder includes a first end having an outwardly flanged end wall and a second end opposite the first end; and said primary housing having an aft end stop flange positioned in said primary housing aft end, said second telescoping cylinder outwardly flanged end wall engaging with said aft end stop flange of said primary housing on extension of said second telescoping cylinder.

6. The apparatus according to claim 5 wherein said second telescoping piston includes:

a piston head slidable between the first and second ends of said second telescoping cylinder; and a piston shaft connected at one end to said piston head and at the other end to said breech mounting, said piston shaft being slidably supported within the second end of said second telescoping cylinder.

* * * * *